US012128525B2

(12) United States Patent
Ebina et al.

(10) Patent No.: US 12,128,525 B2
(45) Date of Patent: Oct. 29, 2024

(54) WORKPIECE SUPPORTING DEVICE, PROCESSING DEVICE, PROCESSING METHOD, METHOD FOR MANUFACTURING BEARING, METHOD FOR MANUFACTURING VEHICLE, AND METHOD FOR MANUFACTURING MECHANICAL DEVICE

(71) Applicant: NSK Ltd., Tokyo (JP)

(72) Inventors: Takeshi Ebina, Fujisawa (JP); Koji Yokoe, Ohtsu (JP); Takashi Yoshimura, Fujisawa (JP)

(73) Assignee: NSK LTD., Tokyo (JP)

( * ) Notice: Subject to any disclaimer, the term of this patent is extended or adjusted under 35 U.S.C. 154(b) by 1254 days.

(21) Appl. No.: 16/650,712

(22) PCT Filed: Mar. 14, 2018

(86) PCT No.: PCT/JP2018/009938
§ 371 (c)(1),
(2) Date: Mar. 25, 2020

(87) PCT Pub. No.: WO2019/097738
PCT Pub. Date: May 23, 2019

(65) Prior Publication Data

US 2020/0282511 A1 Sep. 10, 2020

(30) Foreign Application Priority Data

Nov. 16, 2017 (JP) ..... 2017-220647

(51) Int. Cl.
*B24B 41/06* (2012.01)
*B24B 5/04* (2006.01)
(Continued)

(52) U.S. Cl.
CPC ..... *B24B 41/06* (2013.01); *B24B 5/04* (2013.01); *B24B 5/307* (2013.01);
(Continued)

(58) Field of Classification Search
CPC ..... B24B 41/005; B24B 41/06; B24B 41/061; B24B 41/065; B24B 41/067; B24B 5/04;
(Continued)

(56) References Cited

U.S. PATENT DOCUMENTS 2,182,311 A * 12/1939 Cole ..... B24B 41/065 451/408
2,838,886 A 6/1958 Lovely
(Continued)

FOREIGN PATENT DOCUMENTS

CN 201728556 U 2/2011
GB 931373 A 7/1963
(Continued)

OTHER PUBLICATIONS

International Search Report for PCT/JP2018/009938 dated Jun. 12, 2018 [PCT/ISA/210].
(Continued)

*Primary Examiner* — Laura C Guidotti
*Assistant Examiner* — Sidney D Full
(74) *Attorney, Agent, or Firm* — Sughrue Mion, PLLC

(57) ABSTRACT

A workpiece supporting device (6) includes a base stand (10), a shoe (11) which is disposed on at least one place in a circumferential direction of a workpiece (1*a*) that is rotationally driven using a rotary drive device (4) and is in sliding contact with a circumferential surface of the workpiece (1*a*), and a supporting body (12) which supports the shoe (11) with respect to the base stand (10). The supporting body (12) includes a compliant structure portion (a leaf spring (14)) which tilts the shoe (11) in accordance with
(Continued)

tilting of the workpiece (1*a*) with respect to the base stand (10).

9 Claims, 5 Drawing Sheets

(51) Int. Cl.

| | |
|---|---|
| ***B24B 51/00*** | (2006.01) |
| *B24B 5/307* | (2006.01) |
| *B24B 27/00* | (2006.01) |
| *B24B 41/00* | (2006.01) |

(52) U.S. Cl.
CPC ..... *B24B 27/0076* (2013.01); *B24B 41/005* (2013.01); *B24B 51/00* (2013.01)

(58) Field of Classification Search
CPC .. B24B 5/18; B24B 5/22; B24B 5/307; B24B 51/00
USPC ..... 451/51, 242, 243, 246, 254, 258, 364, 451/387, 388, 398, 402, 405, 4, 7, 408
See application file for complete search history.

(56) References Cited

U.S. PATENT DOCUMENTS 3,431,681 A * 3/1969 Flohr, Jr. ..... B24B 5/307 451/406
6,148,248 A 11/2000 Sun et al.

FOREIGN PATENT DOCUMENTS

| | | | |
|---|---|---|---|
| JP | 11-347896 | A | 12/1999 |
| JP | 2003-117813 | A | 4/2003 |
| JP | 2006-095674 | A | 4/2006 |
| JP | 2007-167996 | A | 7/2007 |
| JP | 2011-098408 | A | 5/2011 |

OTHER PUBLICATIONS

Written Opinion for PCT/JP2018/009938 dated Jun. 12, 2018 [PCT/ISA/237].
Communication dated Oct. 21, 2020, from the European Patent Office in application No. 18878627.1.
Communication dated Jul. 5, 2021, from the European Patent office in application No. 18878627.1.

* cited by examiner

WORKPIECE SUPPORTING DEVICE, PROCESSING DEVICE, PROCESSING METHOD, METHOD FOR MANUFACTURING BEARING, METHOD FOR MANUFACTURING VEHICLE, AND METHOD FOR MANUFACTURING MECHANICAL DEVICE

CROSS REFERENCE TO RELATED APPLICATIONS

This application is a National Stage of International Application No. PCT/JP2018/009938 filed Mar. 14, 2018, claiming priority based on Japanese Patent Application No. 2017-220647 filed Nov. 16, 2017.

TECHNICAL FIELD

The present invention relates to a technique for performing radial positioning of a workpiece (an object to be processed) which is rotationally driven using a rotary drive device.

Priority is claimed on Japanese Patent Application No. 2017-220647, filed Nov. 16, 2017, the content of which is incorporated herein by reference.

BACKGROUND ART

Conventionally, a shoe-type workpiece supporting device is known. Such a supporting device is used, for example, for performing a grinding process or a super finishing process on a workpiece. For example, as shown in FIG. 5, the shoe-type workpiece supporting device performs positioning of a workpiece 1 in a radial direction thereof by sliding a shoe 2 on an outer circumferential surface of the workpiece 1 which is rotationally driven using a rotary drive device.

CITATION LIST

Patent Literature

[Patent Literature 1]
Japanese Patent Application, Publication No. 2007-167996
[Patent Literature 2]
Japanese Patent Application, Publication No. 2011-98408

SUMMARY OF INVENTION

Technical Problem

In a processing device configured to include the shoe-type workpiece supporting device, alignment between the workpiece 1 and the shoe 2 may be shifted due to manufacturing errors or assembling errors of constituent members. That is, a positional relationship between the workpiece 1 and the shoe 2 may be tilted with respect to a normal positional relationship therebetween. Such misalignment includes tilting of a rotational center axis a of the workpiece 1 with respect to a reference axis as shown in FIG. 6(*a*), tilting of a geometric center axis 13 of the workpiece 1 with respect to the rotation center axis a of the workpiece 1 as shown in FIG. 6(*b*) (which causes rotational runout), and the like. For example, the misalignment shown in FIG. 6(*a*) occurs when setting accuracy between a main shaft rotationally driving the workpiece 1 and the shoe 2 is poor, and so on. Also, for example, the misalignment shown in FIG. 6(*b*) occurs when a tip surface of a main shaft (a backing plate) magnetically attracted to an axial side surface of the workpiece 1 is tilted with respect to an imaginary plane orthogonal to a rotational center axis of the main shaft, and so on.

When the workpiece 1 and the shoe 2 are out of alignment, the contact between the outer circumferential surface of the workpiece 1 and the shoe 2 is not surface contact, but line contact or point contact. In this case, since a contact surface pressure between the outer circumferential surface of the workpiece 1 and the shoe 2 exceeds an allowable value due to a pressing force of the shoe 2 against the workpiece 1, contact scratches called shoe scratches (shoe marks) may be generated by the shoe 2 on the outer circumferential surface of the workpiece 1.

Shoe scratches do not impair functions of a product, but usually impair an appearance of the product, and thus they are usually removed by additional processing such as wrapping.

On the other hand, as a means for inhibiting generation of shoe scratches, means for softening a material of a shoe have been proposed (see, for example, Japanese Unexamined Patent Application, First Publication No. 2007-167996, and Japanese Unexamined Patent Application, First Publication No. 2011-98408). However, employing such means alone can inhibit generation of shoe scratches, but increases an amount of wear of the shoe, and thus there is a concern that a life span of the shoe may be shortened, or the like.

An object of the present invention is to provide a means capable of inhibiting shoe scratches from being generated on an outer circumferential surface of a workpiece regardless of a material of a shoe.

Solution to Problem

One aspect of a workpiece supporting device of the present invention includes a base stand, a shoe which is disposed on at least one place in a circumferential direction of a workpiece that is rotationally driven by using a rotary drive device and is in sliding contact with a circumferential surface of the workpiece, and a supporting body which supports the shoe with respect to the base stand, in which the supporting body has a compliant structure portion which tilts the shoe in accordance with tilting of the workpiece with respect to the base stand.

In the case of implementing the workpiece supporting device of the present aspect, for example, the following configuration can be adopted. That is, in one example, the compliant structure portion is configured of an anisotropic elastic portion having deflection rigidity in an axial direction of the workpiece which is smaller than deflection rigidity in the circumferential direction of the workpiece. The anisotropic elastic portion is configured of, for example, a leaf spring.

In another example, the compliant structure portion is configured of a swing supporting structure portion which is centered on a swing supporting shaft oriented in the circumferential direction of the workpiece and swingably supports the shoe with respect to the base stand.

In another aspect, the workpiece supporting device includes a base, a shoe having an abutting surface which abuts a circumferential surface of a workpiece along a line parallel to a first direction for positioning the workpiece that is rotationally driven, and a compliant frame which supports the shoe with respect to the base and allows a change in a posture of the shoe in accordance with a change in tilting of the circumferential surface of the workpiece with respect to the first direction.

In one example, the compliant frame has a blade which is disposed parallel to a plane intersecting the first direction and is disposed at a central position of the abutting surface of the shoe or a central position of the circumferential surface of the workpiece in the first direction.

In this case, for example, the plane includes a second direction along a radial direction of the workpiece and a third direction intersecting the first and second directions, and the blade provides relatively rigid support in the second direction and the third direction and provides relatively flexible support in the first direction.

Alternatively and/or additionally, for example, the plane includes a second direction along a radial direction of the workpiece and a third direction intersecting the first and second directions, and in the first direction, a thickness of the blade is less than half a length of the abutting surface of the shoe or half a length of the outer circumferential surface of the workpiece.

Alternatively and/or additionally, the compliant frame provides relatively rigid support in a second direction along a radial direction of the workpiece and in a third direction intersecting the first and second directions and provides relatively flexible support about an axis along the third direction.

One aspect of a processing device of the present invention includes a rotary drive device which rotationally drives a workpiece, a tool which processes the workpiece, and the workpiece supporting device of the above aspects.

One aspect of a processing method of the present invention is a processing method using the processing device of the above aspect, including steps of: rotationally driving the workpiece using the rotary drive device; and processing the workpiece using the tool while performing positioning of the workpiece in the radial direction of the workpiece by causing the shoe included in the workpiece supporting device to be in sliding contact with the outer circumferential surface of the workpiece.

One aspect of a method for manufacturing a bearing according to the present invention is a method in which a bearing including a bearing ring is an object to be manufactured and the bearing ring is processed using the processing method of the above aspect.

One aspect of a method for manufacturing a vehicle according to the present invention is a method in which a vehicle including a bearing is an object to be manufactured and the bearing is manufactured using the method for manufacturing the bearing of the above aspect.

One aspect of a method for manufacturing a mechanical device according to the present invention is a method in which a mechanical device including a bearing is an object to be manufactured and the bearing is manufactured using the method for manufacturing the bearing of the above aspect. Also, in the mechanical device to be manufactured, it does not matter what kind of power is used (the power may be something other than human power, or the power may be human power).

Advantageous Effects of Invention

According to the aspects of the present invention, it is possible to inhibit shoe scratches from being generated on the outer circumferential surface of a workpiece regardless of the material of a shoe.

DESCRIPTION OF EMBODIMENTS

Figure 1:
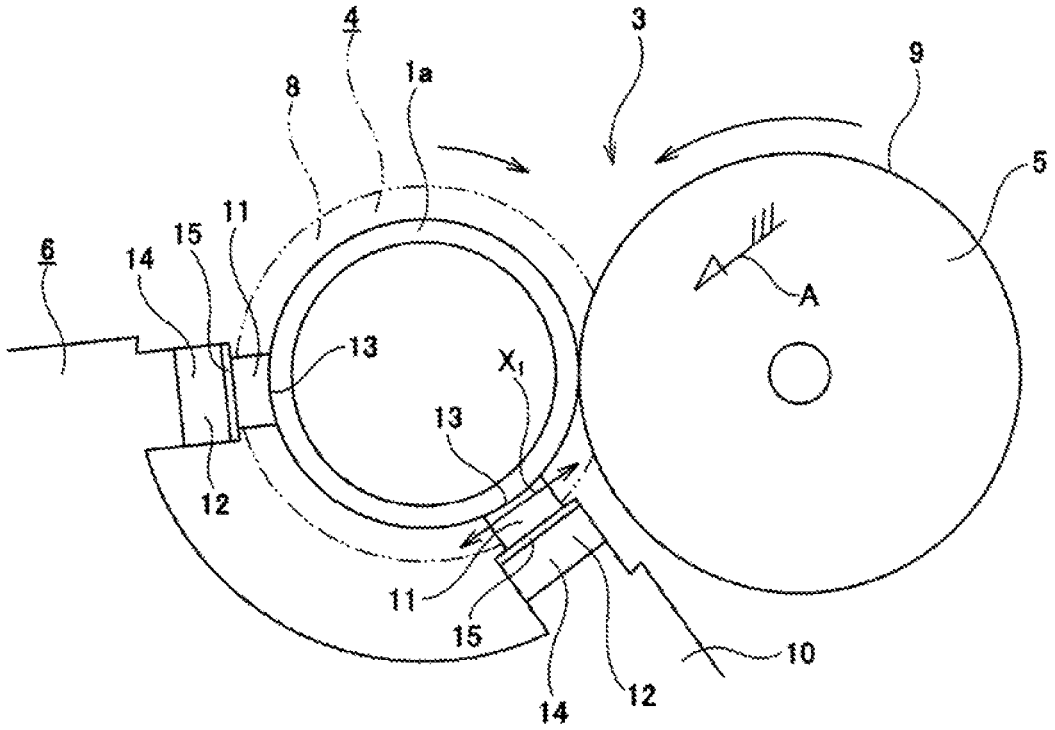
FIG. 1 is a schematic side view showing a first embodiment of the present invention.
Figure 2:
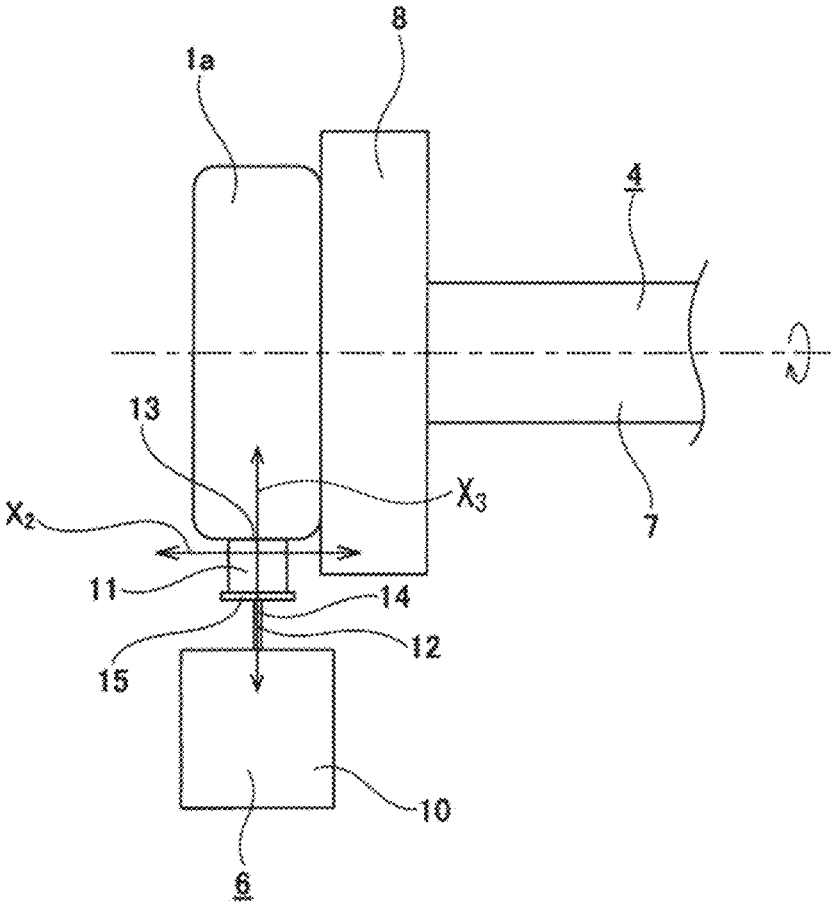
FIG. 2 is a diagram viewed in a direction of arrow A of FIG. 1.

A first embodiment of the present invention will be described with reference to FIGS. 1 to 3. In the present embodiment, a processing device 3 is for performing a grinding process on an outer circumferential surface of a workpiece 1*a* and includes a rotary drive device 4, a grindstone 5 as a tool, and a workpiece supporting device 6. The workpiece 1*a* is, for example, a metal ring-shaped member such as a track ring (an inner ring and an outer ring) that constitutes a radial rolling bearing incorporated in a vehicle or any of various mechanical devices.

The rotary drive device 4 includes a main shaft 7 that can be rotationally driven by a drive source such as an electric motor. The main shaft 7 has a backing plate 8 at a tip portion thereof. The workpiece 1*a* is supported on the main shaft 7 by magnetically attracting an axial side surface thereof to a tip surface of the backing plate 8.

The grindstone 5 has an outer circumferential surface as a grinding surface 9 and is rotatable about its own central axis. In addition, the grindstone 5 can move away from and toward the outer circumferential surface of the workpiece 1*a* in a radial direction thereof. That is, the grindstone 5 can press the grinding surface 9 against the outer circumferential surface of the workpiece 1*a* supported by the main shaft 7.

The workpiece supporting device 6 includes a base stand (base) 10, two shoes 11, and a supporting body (a compliant frame) 12 provided for each of the shoes 11. In another example, the number of shoes 11 can be one or three or more.

The two shoes 11 are disposed apart from each other in a circumferential direction of the workpiece 1*a*. The shoes 11 are disposed such that each tip surface 13 thereof is in sliding contact with the outer circumferential surface of the workpiece 1*a*. The shoes 11 are for at least positioning the workpiece 1*a* in a radial direction thereof. Each of the shoes 11 has the tip surface (abutting surface) 13 which abuts the outer circumferential surface of the workpiece 1*a* along a line parallel to a first direction along a reference axis (for example, a first direction along a reference rotation axis) for positioning of the workpiece 1*a* that is rotationally driven. Each of the two shoes 11 is made of a metal such as steel or cemented carbide and is formed in a substantially rectangular block shape. In one example of the shoe 11, the tip surface (abutting surface) 13, which is an end surface on a side facing the outer circumferential surface of the workpiece 1*a*, is a concave surface having a partially cylindrical shape which can be brought into surface contact with the outer circumferential surface of the workpiece 1*a*. That is, the shoe 11 has the tip surface 13 having the concave surface shape. In other examples of the shoe 11, a tip surface 13 having another shape can be provided. Also, various materials can be adopted for the shoe 11.

Further, in one example, circumferential positions at which the tip surfaces 13 of the two shoes 11 are caused to be in sliding contact with the outer circumferential surface of the workpiece 1*a* may be positions deviated from a circumferential position at which the grindstone 5 (grinding surface 9) is pressed against the outer circumferential surface of the workpiece 1*a* and positions at which a load applied to the workpiece 1*a* from the grindstone 5 can be efficiently supported. In another example, the shoes 11 can be disposed at positions different from the illustrated positions. Also, the tip surfaces 13 of the shoes 11 may have shapes other than the cylindrical concave surfaces described above, and for example, various conventionally known shapes such as V-shaped concave surfaces may be employed.

Each of the two shoes 11 is supported by the base stand 10 via the supporting body (compliant frame) 12. The supporting body 12 includes a leaf spring (a compliant structure portion, a blade, or a spring blade) 14 which is an anisotropic elastic portion, and a holder 15. The supporting body (compliant frame) 12 is configured to support the shoe 11 with respect to the base stand 10 and to allow a change in a posture of the shoe 11 (a change in a direction of the shoe 11 or a change in a direction of the tip surface (abutting surface) 13) in accordance with a change in an inclination of the outer circumferential surface of the workpiece 1*a* with respect to the first direction.

The leaf spring (blade) 14 is disposed in a state in which a thickness direction thereof in a free state substantially coincides with an axial direction of the main shaft 7 (an axial direction of the workpiece 1*a* or the first direction). The leaf spring 14 is disposed parallel to a plane intersecting the first direction. The leaf spring 14 is disposed at a central position of the tip surface (abutting surface) 13 of the shoe 11 in the first direction or a central position of the outer circumferential surface of the workpiece 1*a* in the first direction. In one example, the leaf spring 14 is cantilevered to the base stand 10 by coupling its base end portion, which is an end portion on a distal side with respect to the workpiece 1*a*, to the base stand 10. That is, the leaf spring 14 is cantilevered to the base stand 10 while disposed in a direction in which a deflection rigidity thereof in the circumferential direction (specifically, the X1 direction in FIG. 1, which is a circumferential direction of a portion of the outer circumferential surface of the workpiece 1*a* with which the tip end surface 13 of the shoe 11 is in sliding contact) of the workpiece 1*a* is the highest and the deflection rigidity in the axial direction (specifically, the X2 direction in FIGS. 2 and 3, which is a width direction of the portion of the outer circumferential surface of the workpiece 1*a* with which the tip end surface 13 of the shoe 11 is in sliding contact) of the workpiece 1*a* is the lowest.

As described above, the tip surfaces 13 of the shoes 11 abut on the outer circumferential surface of the workpiece 1*a* along the line parallel to the first direction. The leaf spring (blade) 14 is disposed parallel to a first plane intersecting the first direction. The first plane includes a second direction parallel to a radial direction of the workpiece 1*a* and a third direction intersecting the first and second directions (for example, a direction substantially perpendicular to the first and second directions). The first direction $X_2$ is associated with the thickness direction of the leaf spring 14 and/or a direction along a rotation axis of the workpiece 1*a*, the second direction $X_3$ is associated with a length/height direction of the leaf spring 14 (a direction from the base stand 10 to the shoe 11) and/or the radial direction of the workpiece 1*a*, and the third direction $X_1$ is associated with a width direction of the leaf spring 14 and/or a width of the outer circumferential surface of the workpiece 1*a*. The leaf spring 14 provides relatively rigid support in the second and third directions and provides relatively flexible support in the first direction. Alternatively and/or additionally, the leaf spring 14 provides relatively rigid support in the second and third directions and relatively flexible support about an axis parallel to the third direction.

In one example, in the first direction, a thickness of the leaf spring (blade) 14 (a length of the leaf spring in the first direction) can be substantially equal to or less than 1/10, 1/9, 1/8, 1/7, 1/6, 1/5, 1/4, 1/3, or 1/2 of a length of the tip surface 13 of the shoe 11. Alternatively, in the first direction, the thickness of the leaf spring 14 can be substantially equal to or less than 1/10, 1/9, 1/8, 1/7, 1/6, 1/5, 1/4, 1/3, or 1/2 of a length of the outer circumferential surface of the workpiece 1*a*. When the leaf spring (blade) 14 is configured of a plurality of leaf springs (blades) arranged to overlap each other or arranged side by side in the first direction, a total thickness (a sum of thicknesses) thereof can be similarly set.

In one example, in the third direction, a width of the leaf spring (blade) 14 (a length of the leaf spring in the third direction) can be substantially equal to or greater than 1/2 of the length of the tip surface 13 of the shoe 11. Alternatively, in the third direction, the width of the leaf spring 14 can be substantially equal to or greater than the length of the tip surface 13 of the shoe 11. For example, in the third direction, the width of the leaf spring 14 is substantially equal to or greater than 3/10, 4/10, 5/10, 6/10, 7/10, 8/10, or 10/10 of the length of the tip surface 13 of the shoe 11. Alternatively, the width of leaf spring 14 can be substantially equal to or greater than 2, 3, 4, 5, 6, 7, 8, 9, or 10 times the length of the leaf spring 14. When the leaf spring (blade) 14 is configured of a plurality of leaf springs (blades) arranged to overlap each other or arranged side by side in the first direction, a total length (a sum of widths) thereof can be similarly set.

In one example, the leaf spring 14 has a substantially fixed end fixed to the base stand 10 and a substantially free end connected to the shoe 11. The leaf spring 14 has an extending portion, which extends at least along the second direction, between the fixed end and the free end. For example, the leaf spring 14 can have a substantially planar shape over the range of the leaf spring 14 in the second and/or third direction. In another example, the leaf spring 14 can have a shape with at least one bending portion. The leaf spring 14 can have a uniform thickness or a non-uniform thickness.

In one example, the leaf spring 14 couples a tip portion, which is an end portion on a proximal side with respect to the workpiece 1*a*, to a center of a rear surface in the width direction (a surface on a side opposite to the workpiece 1*a*) of the rectangular plate-shaped holder 15. In addition, the shoe 11 is fixed to a front surface (a surface on the workpiece 1*a* side) of the holder 15. In other examples, the supporting body (compliant frame) 12 can have a holder 14 of another form. Various forms can be adopted for a connection structure between the leaf spring 14 and the shoe 11.

Also, in one example, the coupling position of the base end portion of the leaf spring 14 to the base stand 10 can be adjusted in the radial direction of the workpiece 1*a*. In addition, the radial position of the tip surface 13 of each of the two shoes 11 is adjusted by the adjusting of the coupling position, so that the tip surfaces 13 of the two shoes 11 can be brought into surface contact with outer circumferential surfaces of a plurality of workpieces 1*a* having different sizes (outer diameter dimensions).

In the present embodiment, using the processing device 3 described above, an axial side surface of the workpiece 1*a* is magnetically attracted to the tip surface of the backing plate 8 when the outer circumferential surface of the workpiece 1*a* is ground, thereby supporting the workpiece 1*a* to be rotatably driven on the main shaft 7. Further, by bringing the respective tip surfaces 13 of the two shoes 11 into contact with the outer circumferential surface of the workpiece 1*a*, positioning of the workpiece 1*a* in the radial direction is performed. In addition, in this state, by rotating the main shaft 7, the grinding surface 9 of the grindstone 5 rotating in the opposite direction to the workpiece 1*a* is pressed against the outer circumferential surface of the workpiece 1*a* while the workpiece 1*a* is rotated, thereby performing grinding of the outer circumferential surface of the workpiece 1*a*.

Figure 3:
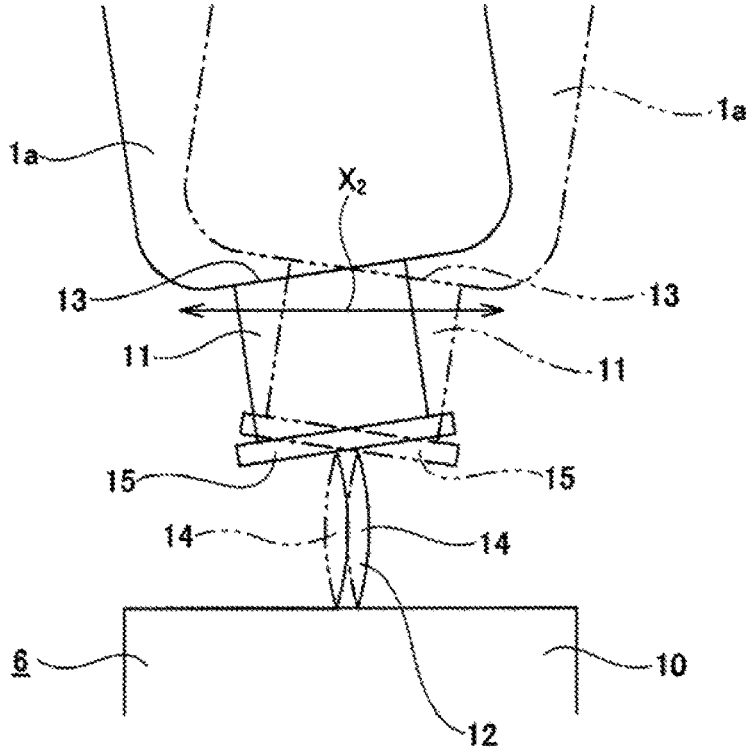
FIG. 3 is a partially enlarged view of FIG. 2 showing a behavior when misalignment occurs.
Figure 6:
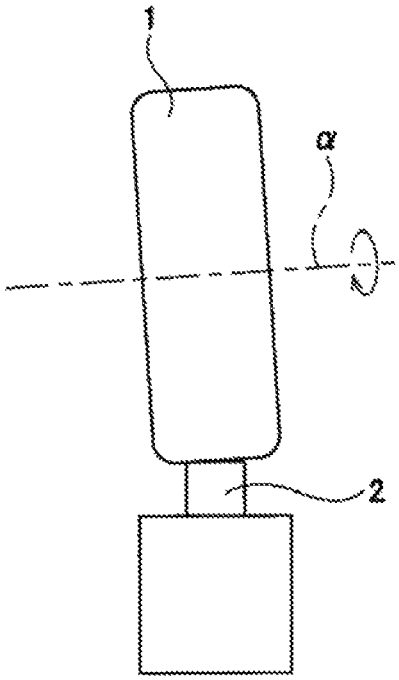
FIGS. 6(*a*) and 6(*b*) are diagrams showing examples in which misalignment has occurred.
Figure 6:
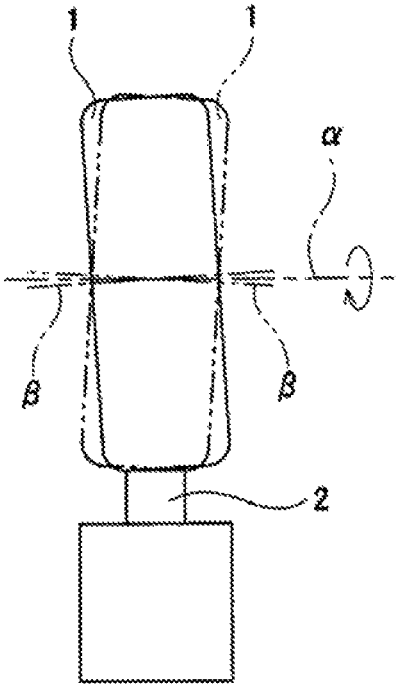

In this case, in the processing device 3, even when the workpiece 1*a* rotates while being tilted with respect to the base stand 10, as shown in FIG. 3, due to misalignment between the workpiece 1*a* and the workpiece supporting device 6 as in a conventional case shown in FIG. 6 described above, occurrence of shoe scratches on the outer circumferential surface of the workpiece 1*a* can be inhibited.

That is, in the processing device 3, the leaf spring 14 supporting the shoe 11 with respect to the base stand 10 is disposed in the direction in which the deflection rigidity in the axial direction (X2 direction) of the workpiece 1*a* is lowest. For this reason, in one example, even when the workpiece 1*a* rotates while being tilted with respect to the base stand 10 as shown in FIG. 3, the leaf spring 14 deflects in the axial direction (X2 direction) of the workpiece 1*a* in accordance with tilting of the workpiece 1*a* as shown in the same figure, whereby the tip surface 13 of the shoe 11 complies the outer circumferential surface of the workpiece 1*a*, so that the tip surface 13 of the shoe 11 can be brought into surface contact with the outer circumferential surface of the workpiece 1*a*. In the supporting body (compliant frame) 12, the posture of the shoe 11 changes in accordance with the change in tilting of the outer circumferential surface of the workpiece 1*a* in the first direction. For this reason, occurrence of shoe scratches on the outer circumferential surface of the workpiece 1*a* can be inhibited. In another example, the leaf spring 14 can show deformation different from that of FIG. 3.

Therefore, when the outer circumferential surface of the workpiece 1*a* is ground, high-speed rotation of the workpiece 1*a* can be achieved. Further, additional processing for removing shoe scratches and the like can be omitted. Therefore, a cycle time for processing the workpiece 1*a* can be shortened.

Also, in the present embodiment, in the processing device 3, the leaf spring 14 is disposed in the direction in which the deflection rigidity in the circumferential direction (X1 direction) of the workpiece 1*a* is highest. For this reason, it is possible to substantially prevent the leaf spring 14 from being deflected in the circumferential direction ($X_1$ direction) of the workpiece 1*a*, and thus the positioning of the workpiece 1*a* in the radial direction by the shoe 11 can be stably performed. Therefore, grinding of the outer circumferential surface of the workpiece 1*a* can be stably performed.

Figure 4:
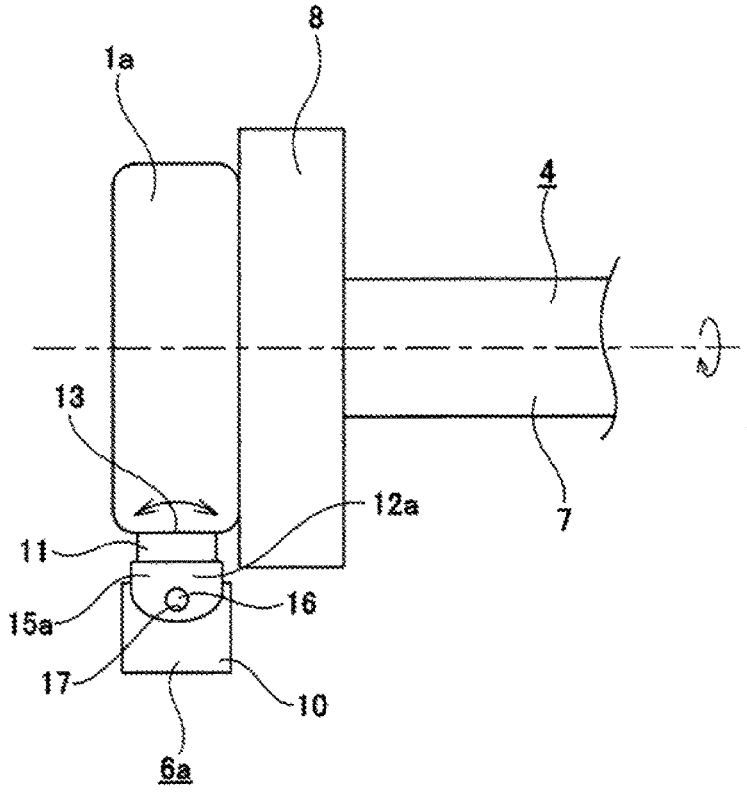
FIG. 4 is a diagram showing a second embodiment of the present invention.
Figure 5:
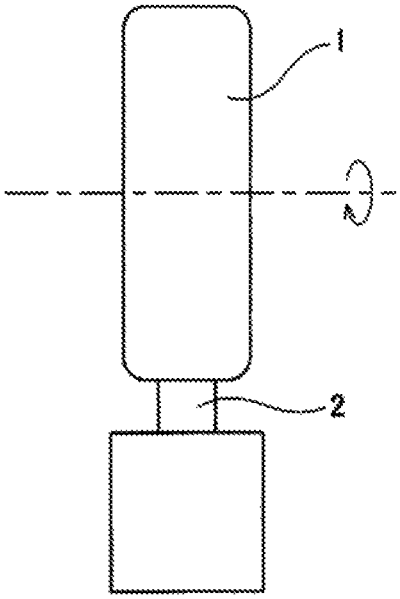
FIG. 5 is a diagram showing a state in which a workpiece is supported using a conventional workpiece supporting device.

A second embodiment of the present invention will be described with reference to FIG. 4. In the present embodiment, in the processing device, a structure of a supporting body 12*a* which supports the shoe 11 with respect to the base stand 10 in a workpiece supporting device 6*a* is different from that of the first embodiment.

In the present embodiment, the supporting body (compliant frame) 12*a* has a holder 15*a* to which the shoe 11 is fixed, and a swing supporting shaft (a pin) 16. The tip surface (abutting surface) 13 of the shoe 11 abuts the outer circumferential surface of the workpiece 1*a* along the line parallel to the first direction (for example, the first direction along the reference rotation axis). The shoe 11 abuts the workpiece 1*a* such that a contact portion between the outer circumferential surface of the workpiece 1*a* and the tip end surface 13 of the shoe 11 extends along the line parallel to the first direction. Alternatively, the shoe 11 abuts the workpiece 1*a* such that the contact portion between the outer circumferential surface of the workpiece 1*a* and the tip end surface 13 of the shoe 11 includes the line parallel to the first direction. The supporting body 12*a* is configured to support the shoe 11 with respect to the base stand (base) 10 and to allow a change in the posture of the shoe 11 (a change in the direction of the shoe 11 or a change in the direction of the tip surface (abutting surface) 13) in accordance with a change in the tilting of the outer circumferential surface of the workpiece 1*a* with respect to the first direction. The support body 12*a* is configured to provide relatively rigid support in the second direction parallel to the radial direction of the workpiece 1*a* and the third direction intersecting the first and second directions (for example, the direction perpendicular to the first and second directions) and to provide relatively flexible support about the axis in the third direction.

In one example, the swing supporting shaft 16 has a columnar shape, is fixed to the base stand 10, and is oriented in the circumferential direction (specifically, a front to back direction in FIG. 4, which is the circumferential direction of the portion of the outer circumferential surface of the workpiece 1*a* with which the tip end surface 13 of the shoe 11 is in sliding contact) of the workpiece 1*a*. The holder 15*a* has a circular engagement hole 17, and the swing supporting shaft 16 engages with (internally fits into) the engagement hole 17 to be relatively rotatable. In the present embodiment, by employing a swing supporting structure portion formed by engaging the swing supporting shaft 16 with the engagement hole 17 as described above, the shoe 11 fixed to the holder 15*a* is supported on the base stand 10 to be swingable around the swing supporting shaft 16 (swingable as shown by an arrow in FIG. 4). Also, in another example, a configuration in which the swing supporting shaft 16 is fixed to the holder 15*a* and the engagement hole 17 is provided in the base stand 10 may be adopted. When such a configuration is adopted, the swing supporting shaft 16 swings (rotates) together with the shoe 11. Various forms can be adopted for the swing structure or the connection structure between the leaf spring 14 and the shoe 11.

In the present embodiment, in the case in which the workpiece 1*a* rotates while being tilted with respect to the base stand 10, due to a misalignment, when the outer circumferential surface of the workpiece 1*a* is ground, the shoe 11 swings about the swing supporting shaft 16 in accordance with the tilting of the workpiece 1*a*, whereby the tip end surface 13 of the shoe 11 complies the outer circumferential surface of the workpiece 1*a*, so that the tip end surface 13 of the shoe 11 can be brought into surface contact with the outer circumferential surface of the workpiece 1*a*. For this reason, occurrence of shoe scratches on the outer circumferential surface of the workpiece 1*a* can be inhibited. Other configurations and operations can be the same as those of the first embodiment.

There is no particular limitation on a type of the workpiece to be used in the present invention, as long as the workpiece has an outer circumferential surface with which the shoe is brought into sliding contact. Also, a processing performed on the workpiece is not limited to the grinding, and may be another processing such as a super-finishing process. Also, a processed portion of the workpiece is not limited to the outer circumferential surface, but may be, for example, an inner circumferential surface or an axial side surface. Also, the number of shoes (the number of combinations of the shoes and the compliant structure) constituting the workpiece supporting device is not limited to two, and may be one or three or more. Also, the workpiece supporting device is not limited to the processing device, and can be used by being incorporated in a measuring machine for measuring properties (for example, roundness or the like) of the workpiece.

Figure 7:
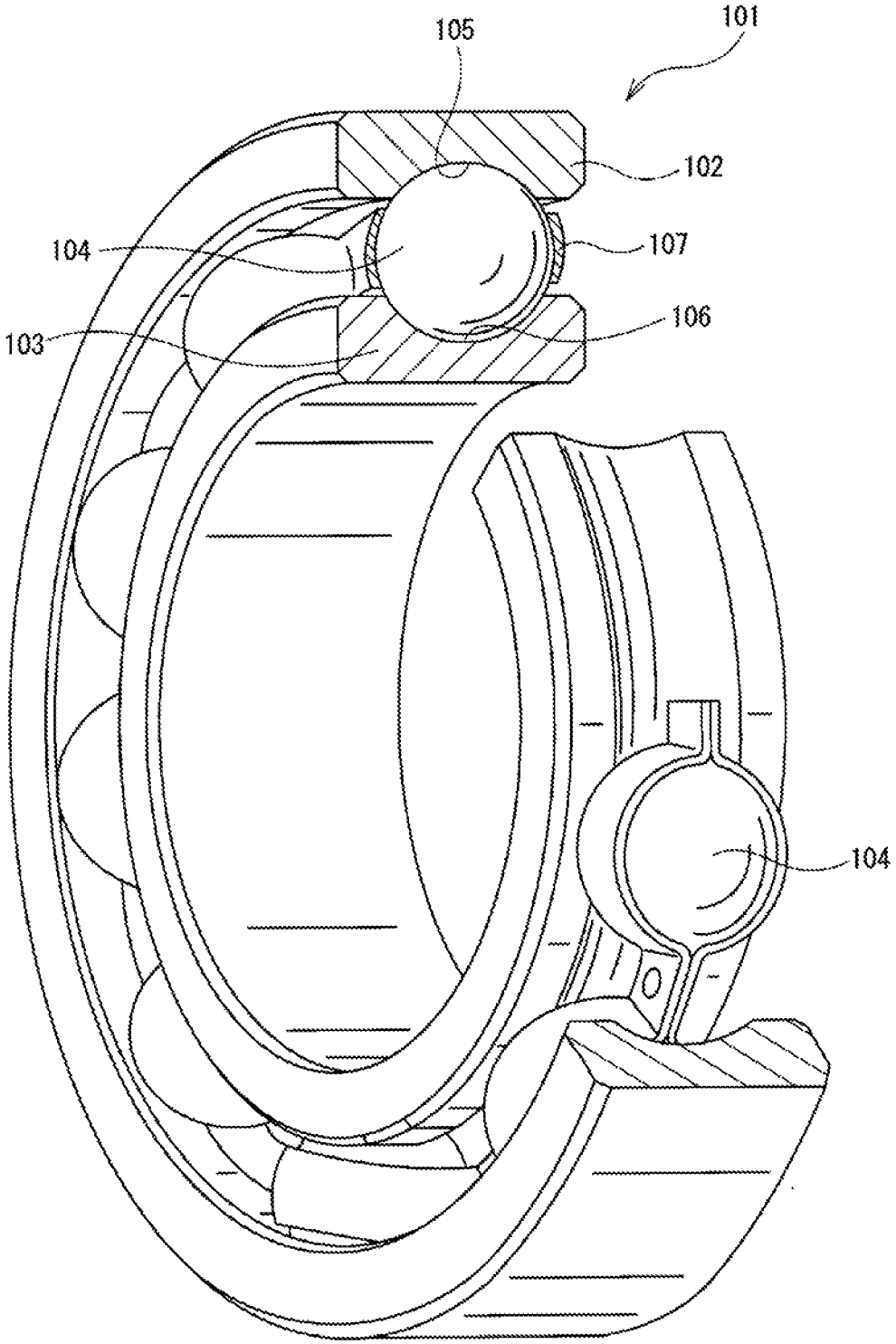
FIG. 7 is a partially cutaway perspective view showing one example of a rolling bearing.

FIG. 7 is a partially cutaway perspective view showing one example of a rolling bearing. A radial ball bearing 100 as shown in FIG. 7 is incorporated in a rotation support portion of various types of rotary devices. In FIG. 7, the rolling bearing 100 is a single-row deep groove type and has a plurality of balls 104 provided between an outer ring 102 and an inner ring 103 which are disposed concentrically with each other. A deep groove type outer raceway 105 is formed over the entire circumference at an axially intermediate portion of an inner circumferential surface of the outer ring 102. A deep groove type inner raceway 106 is formed over the entire circumference at an axially intermediate portion of an outer circumferential surface of the inner ring 103. Each of the balls 104 is disposed to be rotatable between the outer raceway 105 and the inner raceway 106 while being held by a retainer 107. The above bearing 100 is configured such that the outer ring 102 and the inner ring 103 can rotate relative to each other. Various types of bearings can be adopted as the bearing.

REFERENCE SIGNS LIST

1, 1*a* Workpiece
2 Shoe
3 Processing device
4 Rotary drive device
5 Grindstone
6, 6*a* Workpiece supporting device
7 Main shaft
8 Backing plate
9 Grinding surface
10 Base stand (base)
11 Shoe
12, 12*a* Supporting body (compliant frame)
13 Tip surface
14 Leaf spring (blade, spring blade)
15, 15*a* Holder
16 Swing supporting shaft
17 Engagement hole

The invention claimed is:

1. A workpiece supporting device comprising:
a base stand;
a shoe that is disposed on at least one place in a circumferential direction of a workpiece, which is rotationally driven using a rotary drive device, to be in sliding contact with a circumferential surface of the workpiece; and
a supporting body that supports the shoe with respect to the base stand,
wherein the supporting body includes a compliant structure portion which tilts the shoe in accordance with tilting of the workpiece with respect to the base stand, and
the compliant structure portion is configured of an anisotropic elastic portion in which deflection rigidity in an axial direction of the workpiece is smaller than deflection rigidity in the circumferential direction of the workpiece.

2. The workpiece supporting device according to claim 1, wherein the anisotropic elastic portion is configured of a leaf spring.

3. The workpiece supporting device according to claim 1, wherein the compliant structure portion is configured of a swing supporting structure portion which is centered on a swing supporting shaft oriented in the circumferential direction of the workpiece to swingably support the shoe with respect to the base stand.

4. A processing device comprising:
the rotary drive device which rotationally drives the workpiece;
a tool which processes the workpiece; and
the workpiece supporting device according to claim 1.

5. A processing method using the processing device according to claim 4, comprising steps of:
rotationally driving the workpiece using the rotary drive device; and
processing the workpiece using the tool while performing positioning of the workpiece in the radial direction of the workpiece by causing the shoe included in the workpiece supporting device to be in sliding contact with the outer circumferential surface of the workpiece.

6. A method for manufacturing a bearing including a bearing ring, wherein the bearing ring is processed using the processing method according to claim 5.

7. A workpiece supporting device comprising:
a base;
a shoe having an abutting surface which abuts a circumferential surface of a workpiece along a line parallel to a first direction to position the workpiece that is rotationally driven, the first direction being along a rotation axis of the workpiece; and
a compliant frame which supports the shoe with respect to the base and allows a change in a posture of the shoe in accordance with a change in tilting of the circumferential surface of the workpiece with respect to the first direction,
wherein the compliant frame includes a blade which is disposed parallel to a plane intersecting the first direction and is disposed at a central position of the abutting surface of the shoe or a central position of the circumferential surface of the workpiece in the first direction,
the plane includes a second direction along a radial direction of the workpiece and a third direction intersecting the first and second directions,
the blade has a fixed end, which is fixed to the base, and an opposite end, which is connected to the shoe, and the blade extends along the second direction between the fixed end and the opposite end, and
the blade provides rigid support in the second direction and the third direction and provides flexible support in the first direction, and the support in the first direction is flexible relative to each of the support in the second direction and the support in the third direction.

8. The workpiece supporting device according to claim 7, wherein,
in the first direction, a thickness of the blade is less than half a length of the abutting surface of the shoe or half a length of the circumferential surface of the workpiece.

9. The workpiece supporting device according to claim 7, wherein the compliant frame provides rigid support in the second direction and in the third direction and provides flexible support around an axis along the third direction, the support around the axis along the third direction is flexible relative to each of the support in the second direction and the support in the third direction.

* * * * *